United States Patent [19]

Munroe

[11] 4,451,111

[45] May 29, 1984

[54] LIGHTWEIGHT DRAWER SUPPORT ASSEMBLY HAVING COMBINATION LOCKING MECHANISM AND COMMON VERTICAL DRAWER SUPPORT

[76] Inventor: Warren T. Munroe, 8 Birthwood Rd., Windham, N.H. 03087

[21] Appl. No.: 482,771

[22] Filed: Apr. 7, 1983

[51] Int. Cl.[3] ..... E05B 65/46

[52] U.S. Cl. ..... 312/221; 312/3; 312/216; 312/333; 312/222; 211/186

[58] Field of Search ..... 312/107.5, 215, 216, 312/217, 220, 221, 218, 295, 219, 333, 3; 211/186, 126

[56] References Cited

U.S. PATENT DOCUMENTS

| | | | |
|---|---|---|---|
| 1,350,047 | 8/1920 | Way | 312/221 X |
| 2,240,067 | 4/1941 | Bolesky et al. | 312/221 |
| 2,517,757 | 8/1950 | Adlerstein | 312/3 |
| 2,574,692 | 11/1951 | Davidson et al. | 312/293 X |
| 3,888,558 | 6/1975 | Himsl | 312/216 |
| 3,891,288 | 6/1975 | Marquette | 312/293 X |
| 4,118,089 | 10/1978 | Johnson et al. | 312/3 X |
| 4,191,436 | 3/1980 | Cherry | 312/293 |
| 4,270,816 | 6/1981 | Erickson et al. | 312/3 |
| 4,298,236 | 11/1981 | Laroche | 312/216 X |
| 4,382,640 | 5/1983 | Kashden | 312/3 X |

FOREIGN PATENT DOCUMENTS

| | | | |
|---|---|---|---|
| 6291 | of 1908 | United Kingdom | 312/221 |

*Primary Examiner*—William E. Lyddane
*Assistant Examiner*—Thomas Rendos
*Attorney, Agent, or Firm*—Weingarten, Schurgin, Gagnebin & Hayes

[57] ABSTRACT

The lightweight drawer support assembly of the present invention includes a plurality of drawers each having an open frame and a depending flexible compartment. In a closed condition, the drawers are supported in a hollow rectangular frame in vertically stacked alignment on upstanding front and rear fixed drawer support posts. In an open condition out of the hollow interior of the frame, any one of the drawers is supported on its front end by the upstanding fixed front drawer support posts, and on its rear ends on upstanding movable rear drawer support posts slidably mounted to the sides of the hollow frame for movement in a direction generally transverse to their long axes. The upstanding movable rear drawer support posts have a plurality of vertically spaced rearwardly extending projections that yoke and support corresponding laterally and outwardly extending shoulder portions at the rear of the drawers. A plurality of latching arms are rotatably mounted eccentrically to the upstanding fixed rear drawer support posts in registration with the lower rearwardly extending projections and are cooperative therewith to latch the drawers in the closed condition in response to any drawer being in an open condition.

14 Claims, 12 Drawing Figures

FIG. 2
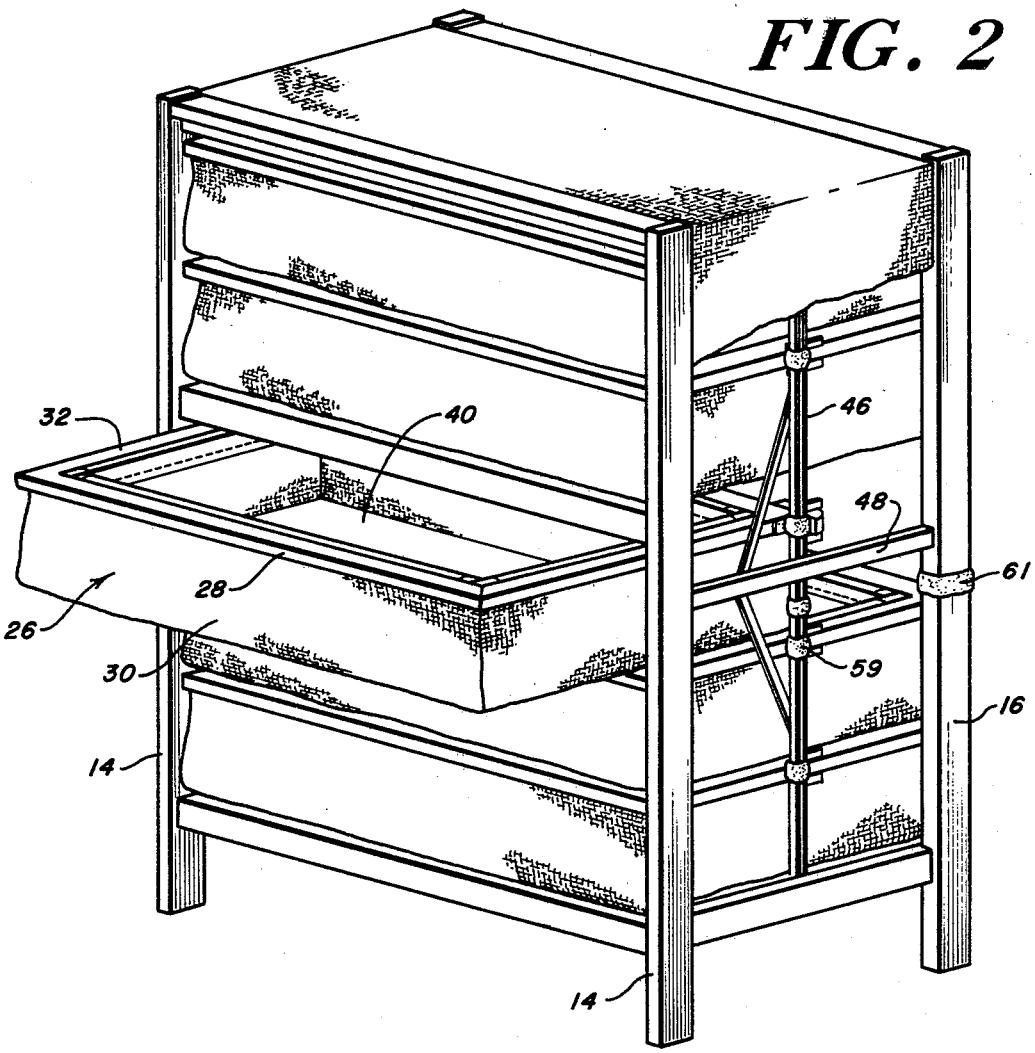
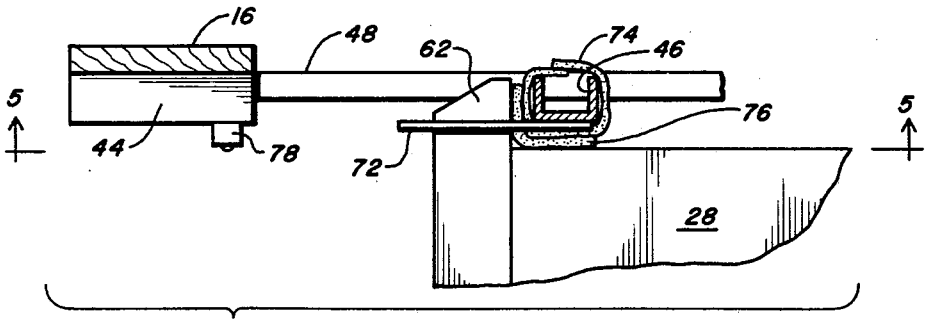
FIG. 3
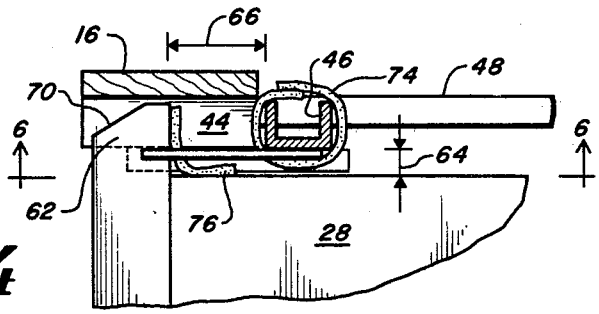
FIG. 4

LIGHTWEIGHT DRAWER SUPPORT ASSEMBLY HAVING COMBINATION LOCKING MECHANISM AND COMMON VERTICAL DRAWER SUPPORT

FIELD OF THE INVENTION

This invention is drawn to the field of cabinet structures, and more particularly, to a novel lightweight drawer support assembly having a combination locking mechanism and a common vertical drawer support.

BACKGROUND OF THE INVENTION

Cabinet structures having a plurality of vertically stacked drawers are commonly used for storage, display, and other purposes. Typically, the sides of the cabinets have horizontally extending elongated guide rails for slidably mounting each of the drawers to the sidewalls of the cabinet. As lumber and other costs increase, woodworkers and furniture manufacturers have minimized the quantity of wood used in such structures by employing plastic, cloth, and other substitute materials. Nonetheless, the heretofore known cabinet structures having a rugged and durable construction, cost considerably more than what many consider a reasonably affordable sum, and the heretofore known cabinet structures that are affordably priced typically are not rugged, reliable, nor durable and often fail in use necessitating costly repair and replacement.

SUMMARY OF THE INVENTION

Cabinets and other structures embodying the novel lightweight drawer support assembly having a combination locking mechanism and a common vertical drawer support of the present invention are extremely rugged in construction, durable in use, lightweight, can be manufactured at modest cost, and readily assembled and knocked-down. The novel lightweight drawer support assembly having a combination locking mechanism and a common vertical drawer support of the present invention contemplates a generally hollow rectangular skeleton frame having open walls for supporting a plurality of vertically stacked drawers in a closed condition, first means slidably mounted to the hollow frame and coupled to the plurality of drawers for supporting any one of the drawers in an open condition, and second means coupled to the hollow frame and to the drawers and cooperative with the first means for latching the drawers in a closed condition in response to any drawer being in an open condition.

In preferred embodiment, front and rear upstanding fixed drawer support posts support the drawers in the vertically stacked closed condition inside the hollow interior of the frame. The front ends of the drawers are laterally supported on laterally and inwardly extending angle brackets fixably mounted at vertically spaced points on confronting surfaces of the upstanding front fixed drawer support posts, and the rear ends are laterally supported and slidably mounted in horizontally extending slots provided therefor at vertically spaced points on confronting surfaces of the upstanding rear fixed drawer support posts.

A pair of upstanding, movable, common rear drawer support posts and combination locking mechanism, mounted to the open side walls of the frame for sliding motion in a direction generally perpendicular to their long axes, support any one of the drawers in an open condition. A plurality of pairs of spaced, upper and lower, rearwardly extending projections are provided on the upstanding movable posts that yoke and support in the open condition a corresponding laterally and outwardly extending drawer shoulder portion provided at the rear of the drawers. A plurality of latching bars are rotatably mounted eccentrically on the upstanding fixed rear drawer support posts at vertically spaced points therealong proximate the horizontally directed rear drawer support slots that cooperate with the lower rearwardly extending projections to lock the drawers not in an open condition inside the hollow frame. An annular length of complimentary hook and loop fasteners such as that manufactured under the trademark VELCRO is slidably mounted over the upstanding movable common rear drawer support posts in the space between respective pairs of upper and lower rearwardly extending projections, and a complementary length of VELCRO is mounted in each of the rear shoulder portions of the drawers. A flexible material is disposed over the open walls to prevent environmentally arising dirt, dust, and the like from entering the hollow interior of the frame and to improve the appearance of the drawer assembly.

In the closed condition, each of the drawers is in vertically stacked alignment in the frame and is supported thereby on its front end on corresponding pairs of vertically spaced, inwardly and laterally extending angle brackets, and on its rear end by corresponding pairs of horizontally extending slots. If any one of the drawers is pulled outwardly, its rear end moves out of the slots, its laterally and outwardly extending shoulder portions engage the common upstanding movable rear drawer support posts, and it rests on the corresponding pair of lower, rearwardly extending projections. As the outward movement of the drawer continues, the plurality of lower rearwardly directed projections move away from the upstanding fixed rear drawer support posts and out of contact with the latching arms, allowing them to rotate into contact with the laterally and outwardly extending shoulders of each of the drawers in the closed condition. The latching arms thereby provide an abutment against which these drawers are all locked in the closed condition. The pair of upper, rearwardly extending projections abut the upper surface of the laterally directed shoulders of the opened drawer to prevent it from toppling out of the drawer support assembly under its own weight. As the opened drawer is moved from an open condition back to its closed condition, the complementary VELCRO strips bring the upstanding movable common rear drawer support posts backwardly along with the drawer. With further inward movement, the plurality of lower rearwardly extending projections are brought into contact with the latching arms and apply a torque thereunto which rotates the arms out of abutment with the shoulders allowing any one of the drawers to again be moved outwardly into an open condition.

BRIEF DESCRIPTION OF THE DRAWINGS

The invention will become better understood by referring to the following exemplary and non-limiting detailed description of the preferred embodiment, and to the drawings, wherein:

FIG. 2 is a front and to the side perspective view of a preferred embodiment of the drawer support assembly having a combination locking mechanism and a common vertical drawer support illustrating a drawer in an open condition according to the present invention;

FIG. 3 is a detailed and fragmentary plan view of a preferred embodiment of the drawer support assembly having a combination locking mechanism and a common vertical drawer support illustrating the rear of a drawer in an open condition according to the present invention;

FIG. 4 is a detailed and fragmentary plan view of a preferred embodiment of the drawer support assembly having a combination locking mechanism and a common vertical drawer support illustrating the rear of a drawer in a closed condition according to the present invention;

DETAILED DESCRIPTION OF THE PREFERRED EMBODIMENT

Figure 1:
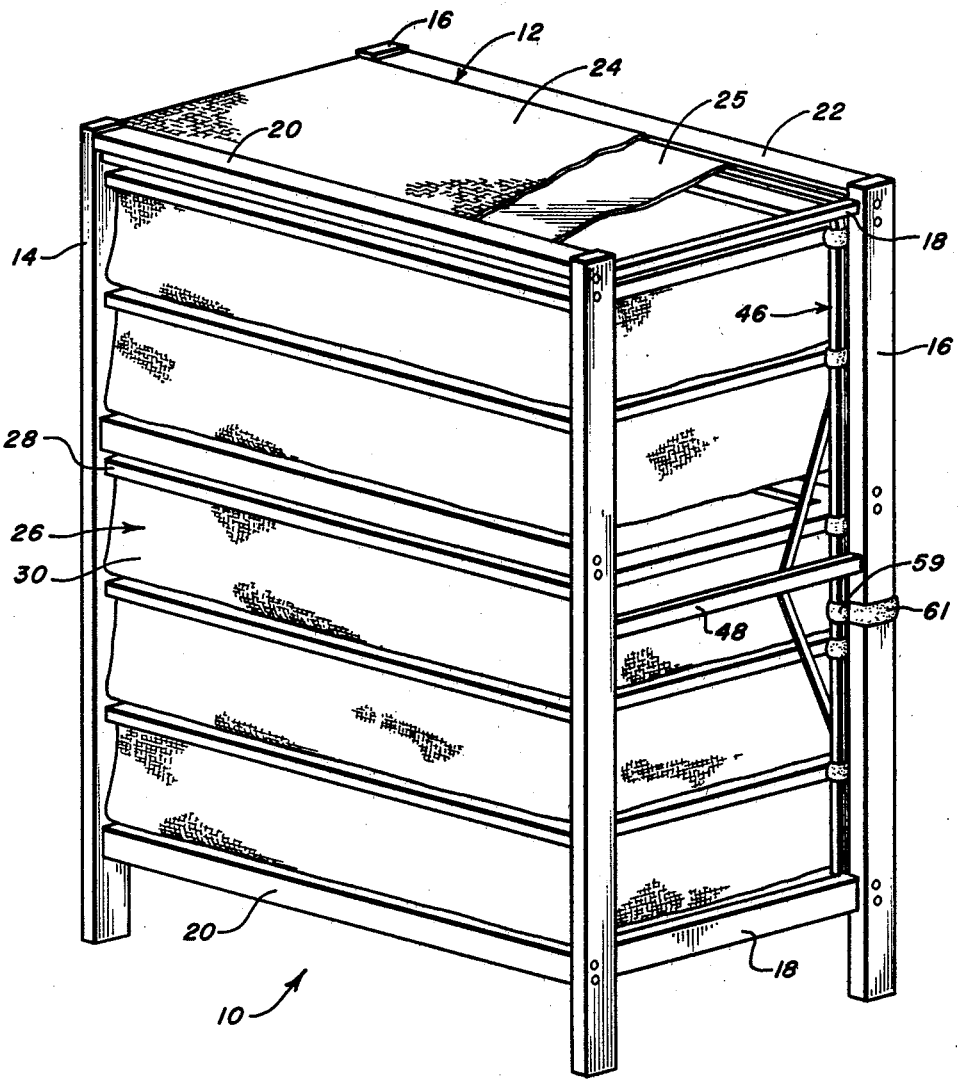
FIG. 1 is a front and to the side perspective view of a preferred embodiment of the novel drawer support assembly having a combination locking mechanism and common vertical drawer support illustrating the drawers in a closed condition according to the present invention.
Figure 5:
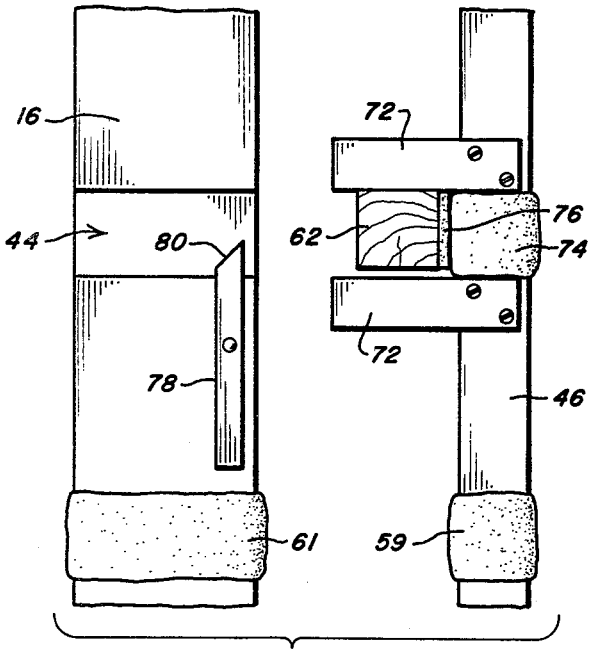
FIG. 5 is an elevational view, partially in section, along the line 5—5 of FIG. 3.
Figure 6:
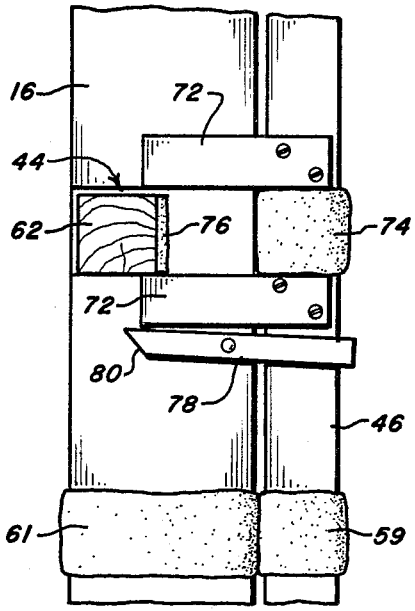
FIG. 6 is an elevational view, partially in section, along the line 6—6 of FIG. 4.
Figure 7:
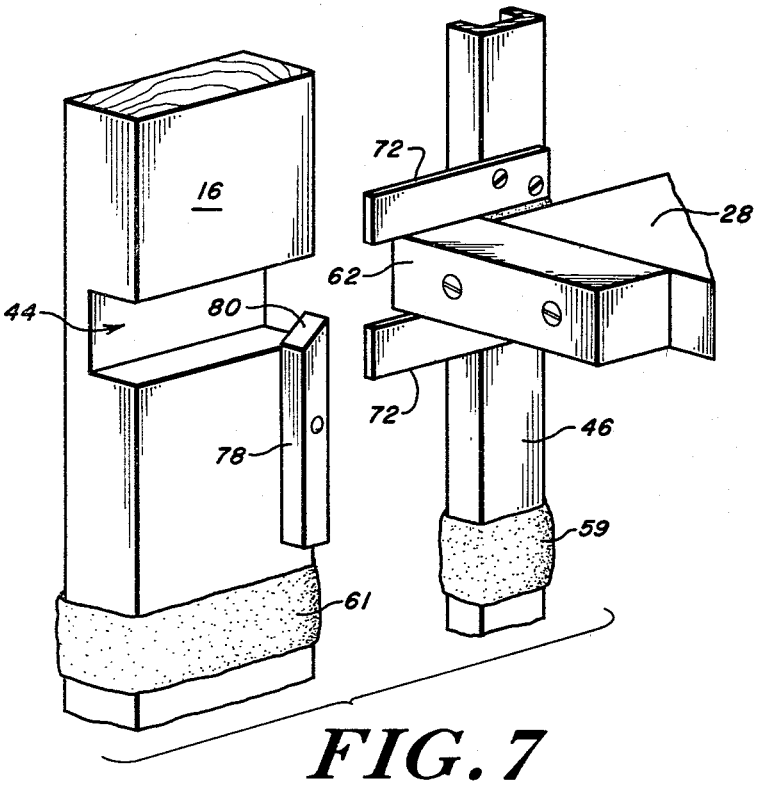
FIG. 7 is a detailed fragmentary perspective view of a preferred embodiment of the drawer support assembly having a combination locking mechanism and common vertical drawer support illustrating the rear of a drawer in an open condition according to the present invention.

Referring now to FIG. 1, generally designated at 10 is a front and to the side perspective view of a preferred embodiment of the drawer support assembly having a combination locking mechanism and a common vertical drawer support illustrating all drawers in a closed condition according to the present invention. The novel drawer support assembly 10 includes a hollow frame generally designated 12 having a pair of upstanding front drawer support posts 14 fixedly connected in spaced-apart parallel relation to a pair of upstanding rear drawer support posts 16 by top and bottom tie arms 18 defining open side and top walls. The pair of upstanding front drawer support posts 14 are fixedly fastened together in spaced-apart parallel relation by top and bottom tie arms 20 defining an open front face, and the pair of upstanding rear drawer support posts 16 are fixedly fastened together in spaced-apart parallel relation by top and bottom tie arms 22 defining an open rear face. A flexible material 24, such as a canvas or other suitable fabric, is removably attached by any suitable means to the open sides and to the open top of the frame 12, such as over a plate 25 slidably mounted in slots provided therefor in the upper tie arms 20, 22, to prevent environmentally arising dirt, dust, and the like from entering into the hollow interior thereof, and to improve the appearance of the assembly 10.

Figure 10:
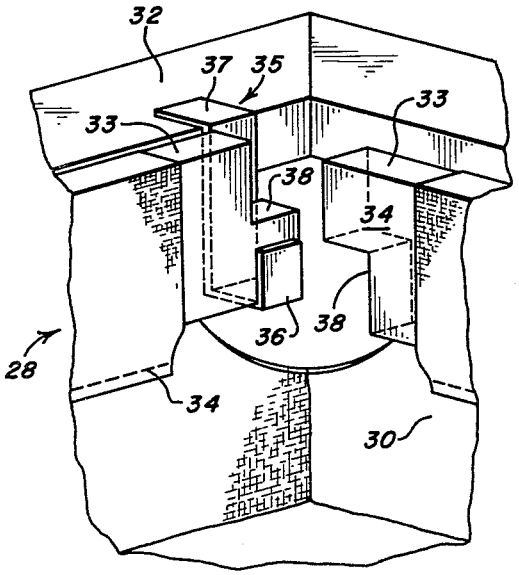
FIG. 10 is a fragmentary isometric view of a drawer of a preferred embodiment of the drawer support assembly having a combination locking mechanism and common vertical drawer support according to the present invention.

A plurality of drawers generally designated 26 are mounted to, and vertically stacked within, the frame 12. Each of the drawers 26 preferably comprise an open frame 28 having a flexible depending fabric compartment 30. Referring now to FIGS. 2 and 10, the open frame 28 preferably consists of four members 32 that are fastened to each other by any suitable means to form a generally open rectangular frame. A plurality of rods 33 are fastened to the top edges of the walls of the flexible compartment 30 by any suitable means, such as in a stitched loop 34, and fastened by the clips generally designated 35 to the members 32. The clips 35 have a generally U-shaped bottom 36 adapted to receive the rods 33, and a flange 37 on the tops thereof for hanging the clips to the members 32. The ends of each of the rods are provided with complementary and interlocking steps 38. To assemble a drawer 26, the flanges 37 of the clips 35 are hung from the top of the members 32, and the rods 33 are supported in the U-shaped bottoms thereof with complementary steps 38 in abutment. The dimensions of the drawer support members 32 and of the rods 33 are such as to provide close-fit frictional support of the flexible compartments 30. It should be noted that if sagging of the rods 33 occurs during use, they may be removed from, and reinserted into the stitched loops in an upside-down orientation. Any suitable rigid member 40, such as a wooden plate, hollow rectangular frame, or slatted member, is disposed into the bottom of the flexible compartments 30 to provide an intended form thereto.

Figure 8:
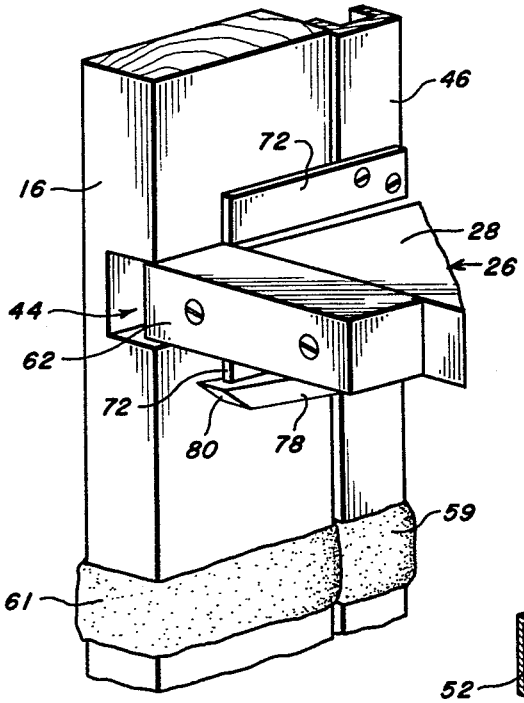
FIG. 8 is a detailed and fragmentary perspective view of a preferred embodiment of the drawer support assembly having a combination locking mechanism and common vertical drawer support illustrating the rear of a drawer in a closed condition according to the present invention.
Figure 11:
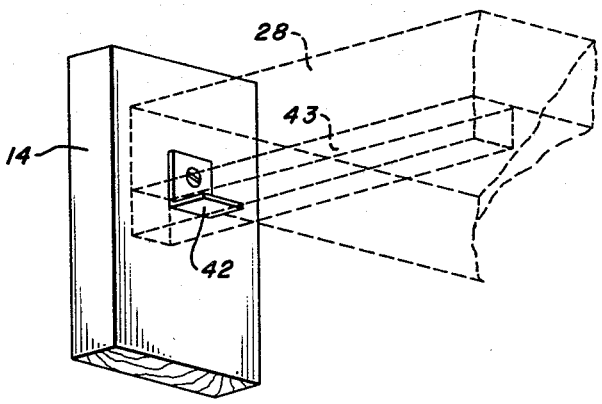
FIG. 11 is a fragmentary isometric view of a drawer of a preferred embodiment of the front drawer support assembly having a combination locking mechanism and common vertical drawer support according to the present invention.
Figure 12:
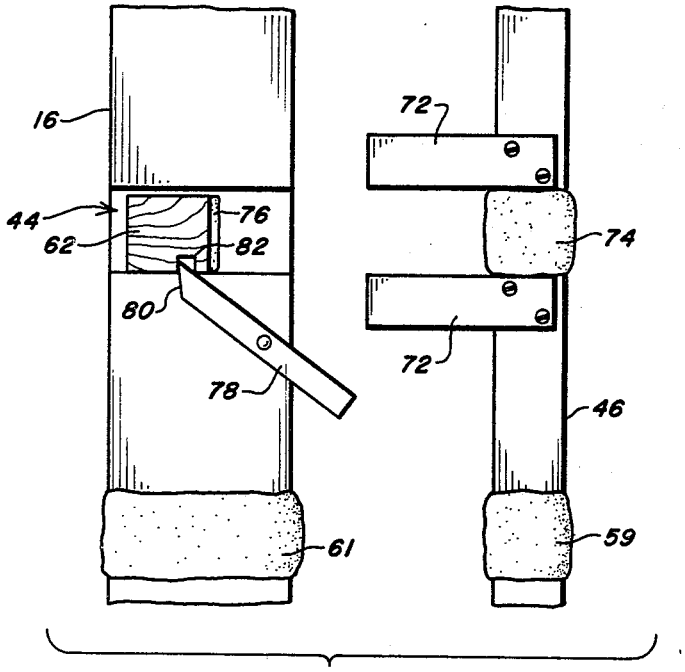
FIG. 12 is a fragmentary elevational view illustrating a latching arm and a drawer in the closed condition, whenever another drawer is in an open condition, of the drawer support assembly having a combination locking mechanism and common vertical drawer support according to the present invention.

Referring now to FIGS. 1, 8 and 11, a plurality of laterally and inwardly directed angle brackets 42 are provided in vertically spaced-apart relation on the confronting inside surfaces of the upstanding front drawer support posts 14. Confronting ones of the angle brackets 42 on the upstanding front drawer support posts 14 are coaxially aligned. A plurality of horizontally extending slots generally designated 44 are provided on the inside surfaces of the upstanding rear support posts 16. Confronting slots on respective ones of the upstanding rear support posts 16 are aligned with respect to each other, and with respect to corresponding pairs of confronting brackets 42 on respective ones of the upstanding front drawer support posts 14. The front ends of the open frames 28 of the drawers 26 rest on confronting ones of the brackets 42, and the rear ends thereof are slidably mounted in confronting ones of the slots 44 in vertically stacked alignment within the hollow interior of the frame 12. The brackets 42 abut a downwardly depending and laterally extending drawer flange 43 in a closed condition to prevent the drawers from being pushed through the frame 12 during closure. It will be appreciated that any other suitable means for mounting the drawers 26 to the frame 12 when in the closed condition, and for preventing the drawers from being pushed through the frame, can be employed as well without departing from the inventive concept.

Figure 9:
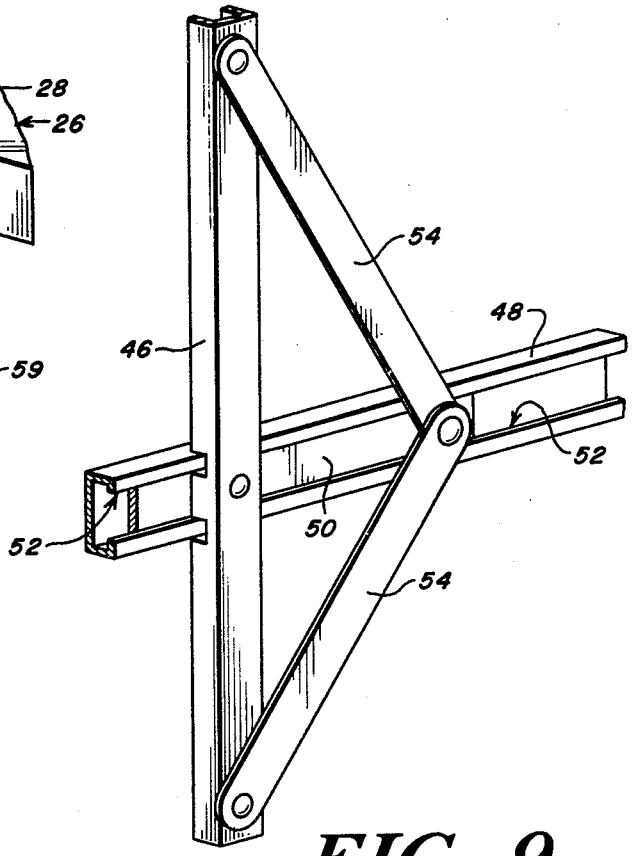
FIG. 9 is a fragmentary isometric view of the upstanding movable rear drawer support posts of a preferred embodiment of the drawer support assembly having a combination locking mechanism and common vertical drawer support according to the present invention.

Referring now to FIGS. 1 and 2, a pair of upstanding movable rear drawer support posts generally designated 46 are slidably mounted in horizontally extending members 48 that are fastened at their ends to the upstanding front drawer support posts 14 and to the upstanding rear drawer support posts 16, one on each side of the frame 12. As will appear more fully below, the upstanding movable rear drawer support posts 46 provide a common vertical support for any one of the drawers when in an open condition, and cooperate with a latching mechanism, to be described, to lock all but the drawer in the open condition in the closed condition inside the hollow frame 12. As shown in FIG. 9, the horizontal members 48 include a carriage 50 slidably mounted between top and bottom rows generally designated 52 of roller bearings. The upstanding movable rear drawer support posts 46 are attached by any suitable means to the carriage 50 such as by nuts and bolts, or rivots. Stabilizing arms 54 are fastened by any suitable means between an end of the carriage 50 and points on the upstanding movable rear drawer support posts 46 that are spaced above and below its point of attachment to the horizontal member 48. Any other suitable means such as nylon wheels can be employed as well for slidably mounting the posts 46. The ends of the members 46 are guided in slots, not shown, provided therefor in the arms 18.

Referring now to FIGS. 1, 4, 6, and 8, when all of the drawers 26 are in a closed position in vertically stacked alignment inside the hollow frame 12, the rearward surface of the upstanding movable rear drawer support posts 46 is in contact with the forward surface of the upstanding rear fixed drawer support posts 16. An annular length of complimentary hook and loop fasteners such as that manufactured under the trademark VELCRO 59 is fastened to the posts 46 and mates with a complementary annular length of VELCRO 61 fastened to the posts 16 to prevent the posts 46 from accidentally sliding into an open condition. A laterally and outwardly extending shoulder 62 is provided along the rear end of each of the frames 28 of the drawers 26 that is slidably mounted into corresponding ones of the confronting pairs of horizontally extending slots 44 provided at spaced-apart vertical points in the upstanding fixed rear drawer support posts 16. Although the shoulder portions 62 are illustrated as separate members threadably fastened to the rear drawer frame member, it will be appreciated that the rear frame member can be of a one-piece construction as well without departing from the inventive concept. The dimensions of the frame 26 of the drawers 28 and the shoulders 62 are such as to provide a first clearance 64 between the lateral inside face of the upstanding movable rear drawer support posts 46 and the confronting lateral surfaces of the frames 28. The dimensions of the frames 28, the posts 16, and the posts 46 are such as to provide a second clearance 66 between the forwardly facing surface of the shoulders 62 and the forwardly facing surfaces of the upstanding fixed rear drawer support posts 16. The laterally and outwardly extending shoulders 62 of the frames 28 are provided with beveled surfaces 70. The surfaces 70 produce restoring forces whenever the drawers 26 are inserted into a corresponding pair of slots 44 out of parallel alignment therewith and act to center the drawers into the slots in proper parallel alignment. The self-aligning drawers thus maintain the clearances 64 during closure which prevents the possibility of the drawers damaging the upstanding movable rear drawer support posts, among other things.

A plurality of pairs of vertically spaced upper and lower rearwardly extending projections 72 are fastened to the upstanding movable rear drawer support posts 46. The upper and lower rearwardly extending projections are spaced-apart a distance that corresponds to the height of the slots 44, and are vertically positioned along the member 46 in registration with the slots 44. A loop of VELCRO 74 is slidably mounted loosely between the pairs of upper and lower rearwardly extending projections 72. A strip of VELCRO 76 is pivotably mounted to the confronting surfaces of the drawer shoulder portions 62 by any suitable means, such as staples or adhesives, to allow its free end to move into and out of engagement with the loop of VELCRO 74.

A plurality of latching arms 78 are rotatably mounted eccentrically to confronting lateral faces of the upstanding fixed rear drawer support posts 16 proximate the slots 44. In the illustrated closed condition of the drawers, the lower ones of the pairs of upper and lower rearwardly extending projections 72 bias the latching arms 78 into a substantially horizontal orientation. As will appear more fully below, whenever a drawer is in an open position, corresponding ones of the lower rearwardly extending projections are no longer in contact with the latching arms 78 and allow their rotation to latch the drawers in the closed condition. The end of each of the arms 78 closest to the point of eccentric mounting is beveled downwardly and to the side to provide an inclined plane 80.

Referring now to FIGS. 2, 3, 5, 7, and 12, when one of the drawers is in an open condition, the shoulders 62 slide out of the slots 44 provided therefor on the upstanding fixed rear drawer supports 16 and the VELCRO strips 76 mounted thereto engage the VELCRO loops 74 slidably mounted loosely around the upstanding movable rear drawer support posts 46. As the drawer 26 (FIG. 1) continues to move outwardly, the shoulders 62 thereof engage and drive the upstanding movable rear drawer support posts 46 outwardly. The open frame 28 of the drawer in the open condition rests on the lower rearwardly extending projections 72. With continued outward movement of a drawer, the lower rearwardly extending projections 72 carried by the engaged upstanding movable rear drawer support posts 46 move out of contact with corresponding ones of the eccentrically mounted latching arms 78. The arms then rotate in unison in the clearances 64,66 (FIG. 4) under their own weight, and the upper beveled surfaces 80 thereof abut and are retained in slots 82 provided therefor in the bottom edges of the laterally extending and forwardly facing surfaces of the drawer shoulder portions of the drawers in the closed condition, thereby preventing their opening while any drawer is in an open condition. The upper rearwardly extending projections 72 provide an abutment against the top surface of the open frame 28 of the drawer 26, which prevents it from toppling outwardly when the drawer is in the open condition.

When a drawer is pushed rearwardly back from an open condition into the closed condition inside the hollow interior of the frame, the complementary VEL- CRO strips, already in engagement, pull the upstanding movable rear drawer support posts 46 rearwardly along with it. With continued rearward motion, the upstanding movable rear drawer supports 46 contact the fixed rear drawer support posts 16, and are stopped in abutting contact therewith. The drawer continues backwardly through the clearance 66 (FIG. 4), and the complementary strips of VELCRO 74,76 disengage. When the drawer is in the closed condition, the plurality of lower rearwardly extending projections 72 contact corresponding ones of the latching arms 78, which are rotated thereby back to the generally horizontal condition out of contact with the corresponding bottom surfaces of the drawer shoulder portions, thereby allowing any drawer to be once again pulled into the open condition. It should be noted that all of the drawers may be manually locked in the closed condition whenever desirable such as to prevent children from opening the drawers. To manually lock all the drawers closed, the posts 46 may be moved outwardly, disengaging the strips 59,61 (FIG. 1), until the projections 72 and the arms 78 are out of engagement. It will be appreciated that any other suitable means for returning the upstanding movable rear drawer support posts, and for providing a common locking mechanism, other than that specifically illustrated, can be employed as well without departing from the inventive concept.

It will be appreciated that many modificatins of the presently disclosed invention will become apparent to those skilled in the art without departing from the scope of the appended claims.

What is claimed is:

1. A lightweight drawer assembly, comprising:

a hollow, substantially rectangular, frame having open walls;

a plurality of open, substantially rectangular, drawer support frames having depending flexible compartments;

first means coupled to said frame for supporting said plurality of drawers one on top of the other in vertically stacked alignment within said hollow interior of said frame in a closed condition;

second means slidably mounted to the open side walls of said frame, coupled to said plurality of drawers, and cooperative with said first means, for supporting any one of said drawers in an open condition out of said hollow interior of said frame; and third means mounted to said frame, and cooperative with said second means, for latching said drawers in a closed condition in response to any drawer being in an open condition.

2. The drawer assembly of claim 1, wherein said frame includes upstanding front and rear drawer support posts in fixed spaced-apart relation defining said open walls, and wherein said first means includes a plurality of vertically spaced laterally and inwardly extending angle brackets provided on confronting lateral faces of said upstanding front drawer support posts, and a plurality of horizontally extending and vertically spaced-apart slots formed on confronting lateral faces of said upstanding rear drawer support posts.

3. The drawer assembly of claim 2, wherein each of said drawers include a generally rectangular open drawer support frame having laterally and outwardly extending shoulders at the rear ends thereof adapted to be slidably received in corresponding horizontally extending slots, and further include fourth means for mounting said depending flexible compartments to said generally rectangular open drawer support frames.

4. The drawer assembly of claim 3, wherein said second means includes a pair of upstanding movable rear drawer support posts slidably mounted to the open sidewalls of said frame for movement in a direction perpendicular to their long axes, said upstanding movable rear drawer support posts having a plurality of vertically spaced pairs of spaced-apart rearwardly extending projections in registration with corresponding horizontally extending slots formed in said upstanding rear drawer support posts, said projection pairs adapted to yoke corresponding ones of said laterally outwardly extending shoulders whenever a respective drawer is in an open condition for supporting the rear thereof.

5. The drawer assembly of claim 4, wherein said fourth means includes a bracket having an upper hanging-flange and a lower U-shaped flange, and further includes a rod having complementarily stepped ends slidably mounted in a stitched loop at the tops of said depending flexible compartments that are adapted to be received in said lower U-shaped flange.

6. The drawer assembly of claim 4, wherein said upstanding movable rear drawer support posts are fastened to carriages that are slidably mounted in horizontal arms that are fastened at their ends to said upstanding front and rear fixed drawer support posts.

7. The drawer assembly of claim 6, further including fifth means coupled to said upstanding movable rear drawer support posts for returning said upstanding movable rear drawer support posts from an open to a closed condition.

8. The drawer assembly of claim 7, wherein said fifth means includes loops of VELCRO slidably mounted loosely between upper and lower rearwardly extending projections, and complementary VELCRO strips pivotably mounted to the confronting faces of said laterally and outwardly extending shoulders.

9. The drawer assembly of claim 4, wherein said third means includes a plurality of latching arms rotatably mounted eccentrically on confronting lateral faces of said upstanding fixed rear drawer support posts proximate said horizontally extending channels.

10. The drawer assembly of claim 9, wherein said latching arms include a bevelled surface on the ends thereof closest to the axis of eccentric rotation.

11. The drawer assembly of claim 4, wherein the lateral and outwardly extending shoulders have bevelled alignment surfaces.

12. The drawer assembly of claim 1, further including a flexible cover removably mounted to the open top, and to the open sides, of said frame.

13. The drawer assembly of claim 7, further including sixth means for removably retaining said upstanding rear drawer support posts in said closed condition thereof.

14. The drawer assembly of claim 13, wherein said sixth means includes first and second loops of VELCRO, said first loop mounted to said upstanding movable rear drawer support post, and said second loop mounted to said upstanding fixed rear drawer support post.

* * * * *